United States Patent [19]

Toyooka et al.

[11] Patent Number: 4,568,015

[45] Date of Patent: Feb. 4, 1986

[54] METHOD OF FORMING ELECTRIC WELDED STEEL TUBE

[75] Inventors: Takaaki Toyooka; Eiichi Yokoyama, both of Handa; Akio Ejima, Taketoyocho; Yoshitomi Onoda, Kofu, all of Japan

[73] Assignee: Kawasaki Steel Corporation, Hyogo, Japan

[21] Appl. No.: 664,103

[22] Filed: Oct. 24, 1984

Related U.S. Application Data

[63] Continuation of Ser. No. 354,637, Mar. 4, 1982, abandoned.

[30] Foreign Application Priority Data

Mar. 11, 1981 [JP] Japan ..... 56-35019
Mar. 11, 1981 [JP] Japan ..... 56-35020
Apr. 23, 1981 [JP] Japan ..... 56-61589

[51] Int. Cl.[4] ..... B23K 31/00; B23K 13/02

[52] U.S. Cl. ..... 228/147; 72/52; 72/181; 219/8.5; 219/10.41

[58] Field of Search ..... 72/52, 51, 235, 234, 72/368, 181; 228/173 F, 150, 149, 147, 146, 166; 219/8.5, 10.41

[56] References Cited

U.S. PATENT DOCUMENTS 2,977,914 4/1961 Gray et al. ..... 228/147
3,555,869 1/1971 Kojima .
3,595,053 7/1971 Oppermann ..... 72/181
3,847,010 11/1974 Zuber ..... 72/52
4,299,108 11/1981 Kato et al. ..... 72/52
4,339,938 7/1982 Nakagawa et al. ..... 72/181

FOREIGN PATENT DOCUMENTS 654298 12/1962 Canada ..... 72/52
1092424 11/1960 Fed. Rep. of Germany ..... 72/52
1800981 8/1970 Fed. Rep. of Germany .
34586 12/1962 Japan ..... 228/147
1286485 8/1972 United Kingdom .

*Primary Examiner*—Daniel C. Crane
*Attorney, Agent, or Firm*—Parkhurst & Oliff

[57] ABSTRACT

In a method of forming an electric welded steel tube, wherein a hot-rolled sheet is formed into a cylindrical shape, with the central portion thereof being lowered as the forming progresses, and thereafter, subjected to reduction in the circumferential direction of the tube by means of tandem type fin-pass rolls to be finished into the tube, the proper forming condition ranges capable of eliminating occurrence of edge waves in the tube seam edge portion and/or of cambers in the longitudinal direction of the tube by three forming conditions factors including the downhill value $D_H$ (downhill coefficient $\eta$) of the hot-rolled sheet, the fin-pass total reduction R of the tandem type fin-pass rolls and the distribution of the fin-pass reduction (the distribution ratio $\delta$ of the first fin-pass reduction).

12 Claims, 16 Drawing Figures

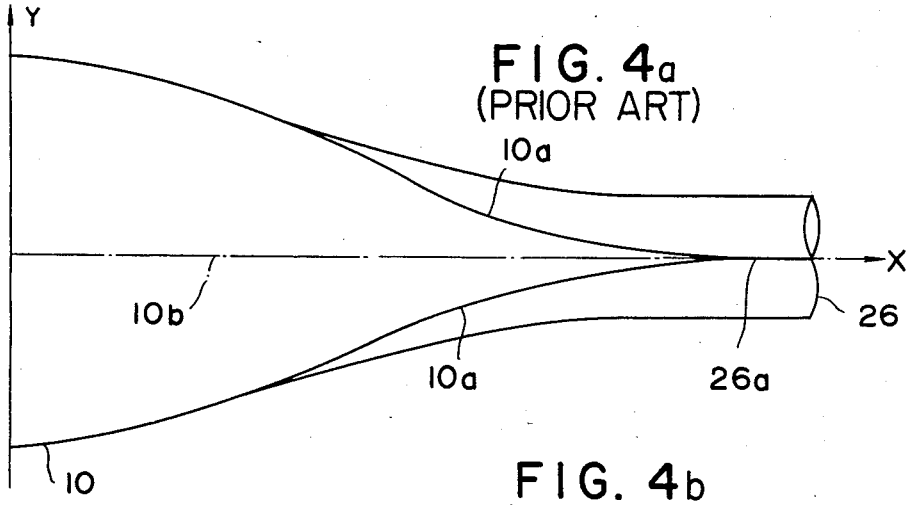
FIG. 4a
(PRIOR ART)
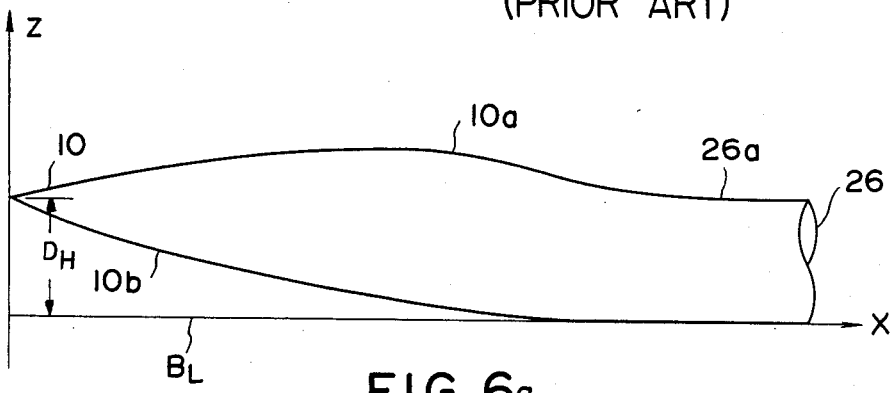
FIG. 4b
(PRIOR ART)
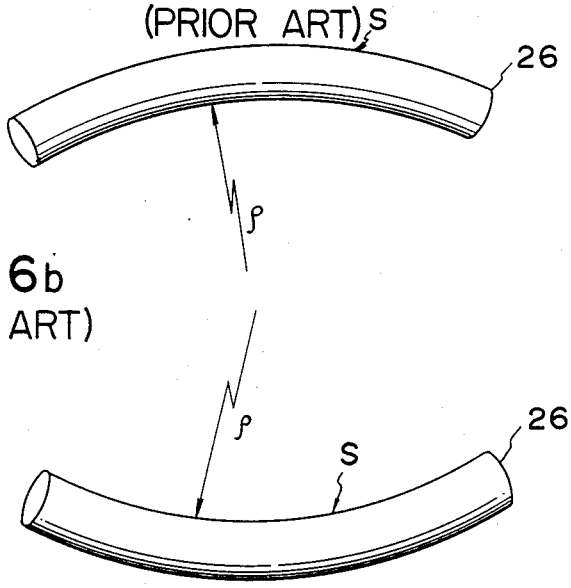
FIG. 6a
(PRIOR ART)
FIG. 6b
(PRIOR ART)

METHOD OF FORMING ELECTRIC WELDED STEEL TUBE

This is a continuation of application Ser. No. 354,637 filed Mar. 4, 1982, now abandoned.

BACKGROUND OF THE INVENTION

1. Field of the Invention

This invention relates to a method of forming an electric welded steel tube, wherein a hot-rolled sheet is formed into a cylindrical shape, with the central portion thereof being lowered as the forming progresses, and thereafter, subjected to reduction in the circumferential direction of the tube by means of tandem type fin-pass rolls to be finished into the tube, and more particularly to a method of forming an electric welded steel tube, being suitable for use in a process of forming an electric welded steel tube, in which cage rolls are used to form a tube, and capable of preventing occurrence of edge waves in the tube seam edge portion and/or of cambers in the longitudinal direction of the tube.

2. Description of the Prior Art

In general, an electric welded steel tube is produced by means of cage rolls as follows. More specifically, as shown in FIGS. 1 and 2, a hot-rolled sheet 10 is progressively formed into a cylindrical shape by means of breakdown rolls 12, edge forming rolls 14, outside cage rolls 16 and inside cage rolls 18 in the initial and middle stages, and thereafter, subjected to reduction in the circumferential direction of the tube by means of tandem type fin-pass rolls 20, 22, 24, being the finishing rolls and comprising: top rolls 20*a*, 22*a* and 24*a*; side rolls 20*b*, 22*b* and 24*b* and bottom rolls 20*c*, 22*c* and 24*c*, and finished into a tube 26 having a predetermined dimension of the tubular shape, with special care being paid to a stable forming of an edge portion 10*a*. FIG. 3 shows the outline of the finished state of the tube in the first fin-pass rolls 20. The tube 26, which has been subjected to reduction in the circumferential direction of the tube, is subjected to high frequency heating at both edge portions 26*a* of the seam thereof, and upset-welded by means of squeeze rolls 28 comprising top rolls 28*a*, side rolls 28*b* and bottom rolls 28*c* to be formed into an electric welded steel tube 29. Additionally, in this cage roll forming, during the initial and middle stages of the forming in general, as shown in FIGS. 2, 4(A) and 4(B) a so-called downhill forming is practiced in which the central portion 10*b* of the hot-rolled sheet 10 is lowered to a base line BL as the forming progresses, whereby a difference between the lengths of paths followed by the edge portion 10*a* and the central portion 10*b* of the hot-rolled sheet 10 is minimized, to thereby control the longitudinal elongation of the edge portion 10*a*. Further, the edge portion 10*a* is continuously, restrainedly supported by means of a plurality of outside cage rolls 16 arranged continuously, whereby a smooth bending occurs.

The downhill type cage roll forming features few occurrences of the edge wave 10*c* during the initial and middle stage of the forming as compared with the conventional step roll forming in which the hot-rolled sheet 10 is formed into a tube 26 by use of breakdown rolls 30 and side cluster roll 32 and fin-pass rolls 34 as shown in FIG. 5. However, with this cage roll forming, during the last stage of the forming, i.e., the zone of the fin-pass forming corresponding to the finishing step, there have been some cases where a longitudinal compressive force acts on the sheet edge portion 10*a*, which has been extended during the initial and middle stage of the forming, and, when this compressive force exceeds the buckling stress limit of the sheet edge portion 10*a*, edge waves have occurred. In general, the formed state of the tube edge portion exerts a considerable influence to the quality of the welded portion in shape, and hence, in particular, there have been encountered with such serious problems as deteriorated quality of the welded portion in shape caused by the edge wave, decreased yield in material and lowered productivity.

Then, in the cage roll forming as described above, a combination of a downhill value $D_H$ of the hot-rolled sheet 10, a total reduction R by the tandem type fin-pass rolls, distribution of the reduction and the like constitutes one of the significant conditions of the forming. However, this combination is not determined definitely, but there are numerous combinations, and the fact is that, heretofore, various conditions for the forming have been empirically adopted. However, the quantitative grasp has not been satisfactorily attained, difficulties have been felt in selecting the proper combination of the conditions of the forming, there have still been occurring edge waves due to mistaken selection of the conditions of the forming in the actual operation, and, particularly, when a tube of non-experience size is produced, difficulties have been encountered in selecting the conditions for the forming and there has been a tendency that occurrence of edge waves has been high in frequency.

In the method of forming a tube as described above, depending upon the selected downhill conditions in the aforesaid forming zone and the selected fin-pass forming conditions, there have been the disadvantage that a camber occurred in the longitudinal direction of the tube 26 after the fin-pass forming as shown in FIG. 6(A) or 6(B). Referring to the drawing, designated at S is a seam portion. Heretofore, this camber of the tube has been sized and corrected by sizing rolls in one of the later processes. However, selection of the conditions of setting the sizing rolls for the sizing and correcting has been very difficult because these rolls are the rolls for the final forming to determine the accuracies in shape and dimensions of the tubular product. As has been described above, heretofore, there has not been performed control in the forming for preventing a camber in the longitudinal direction of the tube by selecting the fin-pass forming conditions, downhill conditions and the like, and the camber caused to the tube has been corrected by sizing rolls in one of the later processes, thus presenting the serious problems including lowered productivity due to increased working time for the correction and decreased accuracies in dimensions of shape through unsatisfactory correction.

SUMMARY OF THE INVENTION

The present invention has been developed to obviate the above-described disadvantages of the prior art and has as its primary object the provision of a method of forming an electric welded steel tube, wherein edge waves in a seam edge portion of the tube can be reliably prevented from occurring by the utilization of the proper forming condition range which is relatively simple and within which the proper forming conditions are readily selectable, and consequently, an electric welded steel tube having an excellent welded portion results.

The present invention has as its second object the provision of a method of forming an electric welded steel tube, wherein a camber in the longitudinal direction of the tube can be reliably prevented from occurring by the utilization of the proper forming condition range which is relatively simple and within which the proper forming conditions are readily selectable, and consequently, an electric welded steel tube having excellent accuracy in dimensions of shape can be produced in stable conditions.

Further, the present invention has as its third object the provision of a method of forming an electric welded steel tube, wherein an edge wave in a seam edge portion of the tube and a camber in the longitudinal direction of the tube can be simultaneously and reliably prevented from occurring by the utilization of the proper forming condition range which is relatively simple and within which the proper forming conditions are readily selectable, and consequently, an electric welded steel tube having a welded portion excellent in quality of shape and having an excellent accuracies in dimensions of shape can be stably produced.

According to the present invention, in a method of forming an electirc welded steel tube, wherein a hot-rolled sheet is formed into a cylindrical shape, lowering the central portion of the hot-rolled sheet as the forming progresses, and thereafter, subjected to reduction in the circumferential direction of the tube by means of tandem type fin-pass rolls to be finished into a tube, the downhill coefficient $\eta$ is selected at a value within a range of 0.3 to 1.3, the downhill coefficient $\eta$ is defined by the ratio DH/D, where DH is defined by the difference of the pass line height between the sheet lead in level and tube bottom level in the downhill forming process, as shown in FIG. 2 and FIG. 4(B), the tube being measured in millimeters, and D is the outer diameter of the tube which is also measured in millimeters resulting in the downhill coefficient being dimensionless; the fin-pass total reduction R is defined as the summation of reduction ratios $r_i$ $$\left(\sum_{i=1}^{n} r_i\right)$$

of all the stands, each having fin-pass rolls, where the reduction ratio in each stand is represented by $r_i = 100 \ln (l_{i-1}/l_i)$ and $r_i$ is the outer circumferential length of the tube at the outlet of the "i'tn" stand, in millimeters, resulting in $r_i$ and R being dimensionless and R, is selected at a value within a range of 0.4% to 1.5% and also within tolerance limits in which the lower limit of the value R rises to about $\eta=0.8$ as the peak and the higher limit of the value R comes down to about $\eta=1.05$ as the peak, in accordance with the value of $\eta$, and further, the distribution ratio $\delta$ of the first fin-pass reduction, the distribution ratio being defined by the percentage ($100\ r_1/R$), where $r_1$ is the first reduction ratio and R is the fin-pass total reduction ratio, hence the distribution ratio is dimensionless and, is set at a value of more than 50% and within tolerance limits in which the lower limit of the value $\delta$ rises to about $\eta=0.8$ as the peak in accordance with the value $\eta$, whereby the tube is formed, thereby enabling to achieve the aforesaid first object.

According to the present invention, in the above-described method of forming an electric welded steel tube, the downhill coefficient $\eta$ is selected at a value within a range of 0.1 to 1.3, the fin-pass total reduction R is selected at a value within a range of 0.4% to 1.4% and also within tolerance limits in which the lower limit of the value R rises to about $\eta=1.3$ as the peak and the higher limit comes down to about $\eta=0.3$ as the peak, in accordance with the value $\eta$, and further, the distribution ratio $\delta$ of the first fin-pass reduction is set at a value of more than 75% and within tolerance limits in which the lower limit of the value $\delta$ rises beyond about $\eta=0.2$ to 1.2 in accordance with the value $\eta$, whereby the tube is produced, thereby enabling to achieve the aforesaid second object.

Further, according to the present invention, in the abovedescribed method of forming an electric welded steel tube, the downhill coefficient $\eta$ is selected at a value within a range of 0.3 to 1.25, the fin-pass total reduction R is selected at a value within a range of 0.55% to 1.25% and also within tolerance limits in which the lower limit of the value R substantially rectilinearly rises from the lowest point of about $\eta=1.05$ and through an intermediate refracting point of about $\eta=0.5$ and the higher limit of the value R comes down from the highest point of about $\eta=0.6$ and through an intermediate refracting point of about $\eta=1.2$, in accordance with the value $\eta$, and further, the distribution ratio $\delta$ of the first fin-pass reduction is set at a value of more than 75% and the lower limit of the value $\delta$ substantially rectilinearly rises from the lowest line of about $\eta=0.45$ to 1.2 in accordance with the value $\eta$, whereby the tube is produced, thereby enabling to achieve the aforesaid third object.

For the purpose of grasping the deformed state of the tube in the fin-pass forming, the inventors of the present invention measured the elongations of the edge portion and the central portion of the tube in the longitudinal direction and found that it became apparent that a difference occurred between the both elongations. As a result, the difference in elongation between the edge portion and the central portion is concerned with the occurrence of a camber in the longitudinal direction of the tube, however, this difference in elongation can be reduced by the conditions of the fin-pass forming. The present invention has been developed based on the above-described idea.

An edge wave occurring in the edge portion 26a of the tube and a camber occurring in the longitudinal direction of the tube are regarded as being caused by the downhill value $D_H$ of the hot-rolled sheet 10 and the conditions of the fin-pass forming (the fin-pass total reduction R and the distribution of reduction), and it has been empirically known in the actual operation that it is important to select the proper combination of these conditions of the forming. The present invention has been developed based on the results of many experiments and studies conducted by the inventors, which were intended to obtain the proper forming condition range capable of eliminating occurrence of edge waves and/or a camber in the cage roll forming, and the present invention contemplates to clarify the proper forming condition range capable of eliminating occurrence of an edge wave and/or a camber by the utilization of three factors of the forming conditions including the downhill value $D_H$ of the hot-rolled sheet, the total reduction R of the tandem type fin-pass rolls, and the distribution of the fin-pass reduction.

The following is the proper forming condition range capable of eliminating occurrence of edge waves, which has been obtained as the results of the experiments and studies made by the inventors.

More specifically, FIG. 7 shows the first proper forming condition range (I) capable of eliminating edge waves, which is determined by the downhill value (Here, it is represented by the downhill coefficient $\eta = D_H/D$, where $D_H$ is the downhill value and D the outer diameter of the tube) and the fin-pass total reduction R $$(\sum_{i=1}^{n} r_i,$$

a total sum of reductions $r_i$ of all the stands each having fin-pass rolls, here, the reduction $r_i$ in each stand is represented by $r_i = 100 \ln(l_{i-1}/l_i)$ by use of the outer circumferential length $l_i$ of the tube at the outlet of The "i'th" stand). In the first proper forming condition range (I), the downhill coefficient $\eta$ was set at a value within a range of 0.3 to 1.3 and the fin-pass total reduction R was set at a value within a range of 0.4% to 1.5%, in which the lower limit of the value R rose to about $\eta = 0.8$ as the peak and the higher limit of the value R came down to about $\eta = 1.05$ as the peak, in accordance with the value $\eta$.

The first proper forming condition range (I) may be represented in outline by the following formulae.

$$R \geqq -1.44 \cdot \eta + 1.552 \quad (1)$$

$$R \leqq 0.51 \cdot \eta + 0.966 \quad (2)$$

$$R \leqq -3.20 \cdot \eta + 4.86 \quad (3)$$

$$R \geqq 0.60 \cdot \eta - 0.08 \quad (4)$$

Here, in FIG. 7, Formule (1) corresponds to a solid line A, Formula (2) to a solid line B, Formula (3) to a solid line C and Formula (4) to a solid line D.

As apparent from FIG. 7, when the downhill value (downhill coefficient $\eta$) is large or small as centered around $\eta = 0.8$ to 1.05, the range of the proper fin-pass total reduction R comes to be small in both cases, and, the range of the downhill value comes to be small with the fin-pass total reduction R being centered around R = 0.7% to 1.1%. When the first proper forming condition range (I) is departed, there are some cases where occurrence of edge waves becomes remarkable, and buckling of the tube edge portion in the circumferential direction of the tube and unsatisfactory shape of the tube tend to occur.

On the other hand, as for the relationship between the downhill value $D_H$ (represented by the downhill coefficient $\eta$) and the distribution of the fin-pass reduction, as the results of study, it has been found that the distribution of the first fin-pass reduction chiefly exerts a large influence onto occurrence of edge waves, but, the distributions of the second and third fin-pass reductions exert relatively small influences onto occurrence of edge waves. As the results of the experiments conducted based on the above-described knowledge, there was obtained the second proper forming condition range (II) capable of eliminating occurrence of edge waves, which was determined by the downhill value $D_H$ (represented by the downhill coefficient $\eta$) and a distribution ratio $\delta(=100 \cdot r_1/R)$ of the first fin-pass reduction. In the second proper forming condition range (II), as shown in FIG. 8, the downhill coefficient $\eta$ was also set at a value within a range of 0.3 to 1.3, and the distribution ratio $\delta$ of the first fin-pass reduction was set at a value of more than 50%, in which condition the lower limit of the distribution raito $\delta$ rose to about $\eta = 0.8$ as the peak in accordance with the value $\eta$. This second proper forming condition range (II) may be represented in outline by the following formulae.

$$\delta \geqq -200 \cdot \eta + 160 \quad (5)$$

$$\delta \geqq -75 \cdot \eta + 110 \quad (6)$$

$$\delta \geqq 62.5 \cdot \eta \quad (7)$$

$$\delta \geqq 250 \cdot \eta - 225 \quad (8)$$

Here, in FIG. 8, Formula (5) corresponds to a solid line E, Formula (6) to a solid line F, Formula (7) to a solid line G and Formula (8) to a solid line H.

As apparent from FIG. 8, when the downhill value (downhill coefficient $\eta$) is large or small as centered around $\eta = 0.8$, the proper range of the distribution ratio $\delta$ of the first fin-pass reduction comes to be small in both cases and tends to be shifted to the side of higher distribution. When the second proper forming condition range (II) is departed, there are some cases where occurrence of edge waves becomes remarkable, and buckling of the tube edge portion in the circumferential direction tends to occur.

As described above, the proper forming condition range capable of eliminating occurrence of edge waves according to the present invention simultanuously satisfies both the first and the second proper forming condition ranges (I) and (II), edge waves which would otherwise occur in the seam edge portion of the tube can be prevented from occurring by the selection of the downhill value of the sheet, the fin-pass total reduction of the tandem type fin-pass rolls and the distribution of the first fin-pass reduction, all of which do not depart from both the first and second proper forming condition ranges (I) and (II), and consequently, an electric welded steel tube excellent in quality of shape in the welded portion can be stably produced. For example, a high strength thin wall electric welded steel tube being of t/D of 1% and which has heretofore been posing the problem of occurrence of edge waves can be stably produced now.

The following is the proper forming condition range capable of eliminating occurrence of cambers which has been obtained as the results of the experiments and studies conducted by the inventors.

More specifically, firstly, in the first proper forming condition range (III) capable of eliminating occurrence of cambers which is determined by the downhill value (represented by the downhill coefficient $\eta$) and the fin-pass total reduction R, as shown in FIG. 9, the downhill coefficient $\eta$ was set at a value within a range of 0.1 to 1.3, the fin-pass total reduction R was set at a value within a range of 0.4% to 1.4%, in which condition the lower limit of the value R rose to about $\eta = 1.3$ as the peak and the higher limit thereof came down to about $\eta = 0.3$ as the peak, in accordance with the value $\eta$. This first proper forming condition range (III) may be represented in outline by the following formulae.

$$R \geqq -0.542\eta + 1.104 \quad (9)$$

$$R \leqq 1.750\eta + 0.875 \quad (10)$$

$$R \leqq -0.444\eta + 1.533 \quad (11)$$

$$R \leqq -6.00\eta + 8.20 \quad (12)$$

Here, in FIG. 9, Formula (9) corresponds to a solid line I, Formula (10) to a solid line J, Formula (11) to a solid line K and Formula (12) to a solid line L.

When the downhill coefficient $\eta$ and the fin-pass total reduction R, which depart from this first proper forming condition range (III), are adopted, occurrence of cambers in the longitudinal direction become remarkable.

On the other hand, also, as for the relationship between the downhill value $D_H$ (represented by the downhill coefficient $\eta$) and the distribution of the fin-pass reduction, as the results of study, it has been found that the distribution of the first fin-pass reduction chiefly exerts a large influence onto occurence of cambers, but the distributions of the second and the third fin-pass reductions exert relatively small influences onto occurrence of cambers. As the results of the experiments conducted based on the above-described knowledge, there was obtained the second proper forming condition range (IV) capable of eliminating occurrence of cambers, which was determined by the downhill coefficient $\eta$ and the distribution ratio $\delta$ ($=100 \cdot r_1/R$) of the first fin-pass reduction. In the second proper forming condition range (IV), as shown in FIG. 10, the downhill coefficient $\eta$ was also set at a value within a range of 0.1 to 1.3, and the distribution ratio $\delta$ of the first fin-pass reduction was set at a value of more than 75%, in which condition the lower limit of the distribution ratio $\delta$ rose to beyond about $\eta=0.2$ to 1.2 in accordance with the value $\eta$. This second proper forming condition range (IV) may be represented in outline by the following formulae.

$$\delta \geqq -250 \cdot \eta + 125 \quad (13)$$

$$\delta \geqq 75 \quad (14)$$

$$\delta \geqq 250 \cdot \eta - 225 \quad (15)$$

Here, in FIG. 10, Formula (13) corresponds to a solid line M, Formula (14) to a solid line N and Formula (15) to a solid line O.

When the downhill coefficient $\eta$ and the distribution ratio $\delta$ of the first fin-pass reduction, which depart from this second proper forming condition range (IV), are adopted, occurrence of cambers in the longitudinal direction of the tube also becomes remarkable.

As described above, the proper forming condition range capable of eliminating occurrence of cambers in the longitudinal direction of the tube according to the present invention simultaneously satisfies both the first and the second proper forming condition ranges (III) and (IV), cambers which would otherwise occur in the longitunal direction of the tube can be prevented from occurring by the selection of the downhill value, the fin-pass total reduction and the distribution of the first fin-pass reduction, all of which do not depart from both the first and the second proper forming condition ranges (III) and (IV), and consequently, an electric welded steel tube excellent in quality of dimensions of shape can be stably produced. Additionally, the camber correcting operation by use of sizing rolls in one of the later steps, which has heretofore been practised, can be saved, thus enabling to improve the operating efficiency and productivity.

In order to prevent both the edge waves and cambers, all of the above-described proper forming condition ranges (I), (II), (III), and (IV) should be satisfied. However, to do this, it is required to select the conditions with complexity to some extent. The followings are the simplified proper forming condition ranges capable of eliminating occurrence of both the edge waves and cambers, which have been obtained as the results of the experiments and studies conducted by the inventors.

More specifically, in the first proper forming condition range (V) capable of eliminating occurrence of edge waves and cambers, which was determined by the downhill value (represented by the downhill coefficient $\eta$) and the fin-pass total reduction, as shown in FIG. 11, the downhill coefficient $\eta$ was set at a value within a range of 0.3 to 1.25, the fin-pass total reduction R was set at a value within a range of 0.55% to 1.25%, in which the lower limit of the value R substantially rectilinearly rose from the lowest point of about $\eta=1.05$ and through an intermediate refracting point of about $\eta=0.5$ and the higher limit of the value R substantially rectilinearly came down from the highest point of about $\eta=0.6$ and through an intermediate refracting point of about $\eta=1.2$. This first proper forming condition range (V) may be represented in outline by the following formulae.

$$R \geqq -1.45 \cdot \eta + 1.555 \quad (16)$$

$$R \leqq 0.43 \cdot \eta + 0.991 \quad (17)$$

$$R \leqq -0.42 \cdot \eta + 1.502 \quad (18)$$

$$R \leqq -6.6 \cdot \eta + 8.920 \quad (19)$$

$$R \geqq -0.6 \cdot \eta - 0.080 \quad (20)$$

$$R \geqq -0.51 \cdot \eta + 1.086 \quad (21)$$

Here, in FIG. 11, Formula (16) corresponds to a solid line P, Formula (17) to a solid line Q, Formula (18) to a solid line R, Formula (19) to a solid line S, Formula (20) to a solid line T and Formula (21) to a solid line U.

As apparent from FIG. 11, when the downhill value (downhill coefficient $\eta$) is large or small as centered around $\eta=0.6$ to 1.05, the range of the proper fin-pass total reduction R comes to be small in both cases. When this first proper forming condition range (V) is departed, there are some cases where occurrence of edge waves or cambers becomes remarkable, and buckling of tube edge portion in the circumferential direction tends to occur.

On the other hand, as for the relationship between the downhill value $D_H$ (represented by the downhill coefficient $\eta$) and the distribution of the fin-pass reduction, as the results of study, it has been found that the distribution of the first fin-pass reduction chiefly exerts a large influence onto occurrence of edge waves and cambers, but the distributions of the second and the third fin-pass reductions exert relatively small influences onto occurrence of edge waves and cambers. As the results of the experiments conducted based on the above-described knowledge, there was obtained the second proper forming condition range (VI) capable of eliminating occurrence of edge waves and cambers, which was determined by the downhill value $D_H$ represented by the downhill coefficient $\eta$ and the distribution ratio $\delta(=100 \cdot r_1/R)$ of the first fin-pass reduction. In the second proper forming condition range (VI), as shown in FIG. 12, the downhill coefficient $\eta$ was also set at a value within a range of 0.3 to 1.25, and the distribution ratio $\delta$ of the first fin-pass reduction was set at a value of more than 75%, in which the lower limit of the distribution ration $\delta$ substantially rectilinearly rose from the lowest line of about $\eta=0.45$ to 1.2. This second proper forming condition range (VI) may be represented in outline by the following formulae.

$$\delta \geqq -166.67 \cdot \eta + 150 \quad (22)$$

$$\delta \geqq 75 \quad (23)$$

$$\delta \geqq 500 \cdot \eta - 525 \quad (24)$$

Here, in FIG. 12, Formula (22) corresponds to a solid line V, Formula (23) to a solid line W and Formula (24) to a solid line X.

When the downhill coefficient $\eta$ and the distribution ratio $\delta$ of the first fin-pass reduction, which depart from this second proper forming condition range (VI), are adopted, occurrence of edge waves or cambers becomes remarkable.

As described above, the simplified proper forming condition range capable of eliminating occurrence of edge waves and cambers according to the present invention simultaneously satisfies both the first and second proper forming condition ranges (V) and (VI), edge waves in the seam edge portion of the tube and cambers in the longitudinal direction of the tube, both of which would otherwise occur can be simultaneously and reliably prevented from occurring by the selection of the downhill value, the fin-pass total reduction and the distribution of the first fin-pass reduction, all of which do not depart from both the first and the second proper forming condition ranges (V) and (VI), and consequently, an electric welded steel tube excellent in quality of shape in the welded portion and in quality of dimensions of shape can be stably produced. Additionally, the camber correcting operation by use of sizing rolls in one of the later steps, which has heretofore been practised, can be saved, thus enabling to improve the operating efficiency and productivity.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein:

FIGS. 4(A) and 4(B) are a plan and a front views schematically showing the forming conditions and the downhill forming conditions of the hot-rolled sheet;

FIGS. 6(A) and 6(B) are perspective views showing the tubes in which a camber or an inverted camber occurred;

DETAILED DESCRIPTION OF THE INVENTION

Detailed description will hereunder be given of the embodiments of the present invention with reference to the drawings.

Firstly, description will be given of the method of selecting the proper forming conditions capable of eliminating occurrence of edge waves in conjunction with a first embodiment of the present invention. In the case of adopting the downhill forming by the downhill coefficient $\eta=0.6$ for example, the fin-pass total reduction R and the distribution ratio $\delta$ of the first fin-pass reduction are selected in consideration of improvements in the yield rate of the material and prevention of occurrence of flaws in rolls such that the fin-pass total reduction R is set at a value within a range of about 0.7% to 1.3% as apparent from FIG. 7 and the distribution ratio $\delta$ of the first fin-pass reduction is set at a value within a range of 65% to 100% as apparent from FIG. 8. With the above-described arrangement, a tube free from edge waves can be formed. Additionally, as for the selection of the downhill value, it must be very useful in improving the productivity in the actual operation as viewed from the problem of the periods of time required for changes in the downhill value setting to select the downhill value $D_H$ so that the proper forming condition range of the fin-pass total reduction R and the distribution ratio $\delta$ of the first fin-pass reduction in the first embodiment can be relatively wide.

Figure 1:
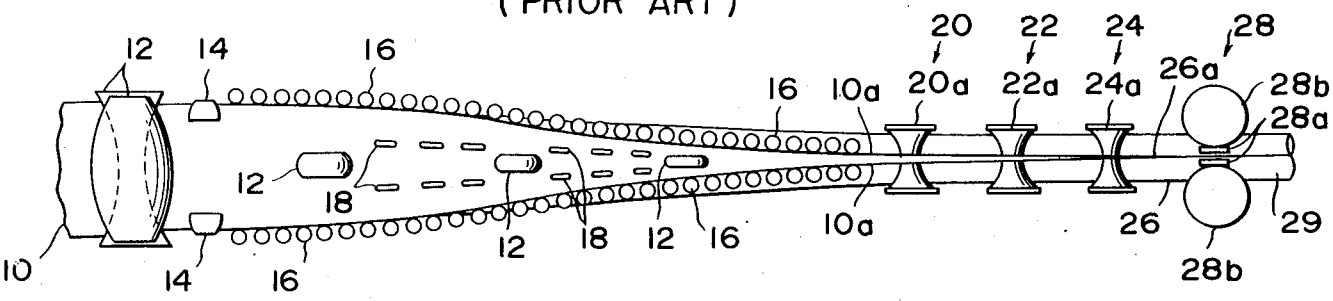
FIG. 1 (PRIOR ART)
FIG. 1 is a plan view showing the method of forming an electric welded steel tube in the cage roll type electric welded steel tube forming mill.
Figure 2:
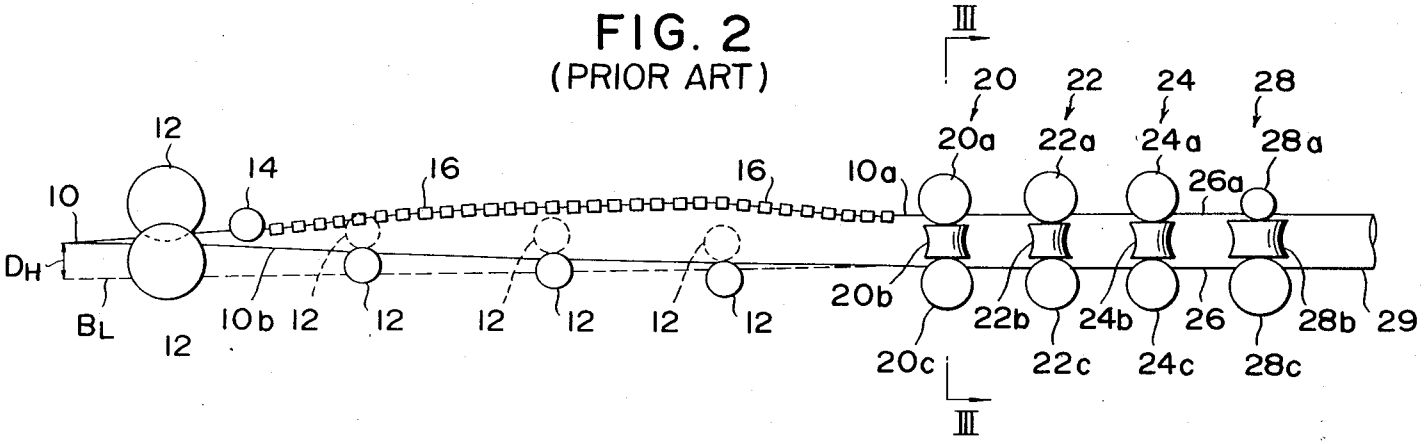
FIG. 2 (PRIOR ART)
FIG. 2 is a front view thereof.
Figure 3:
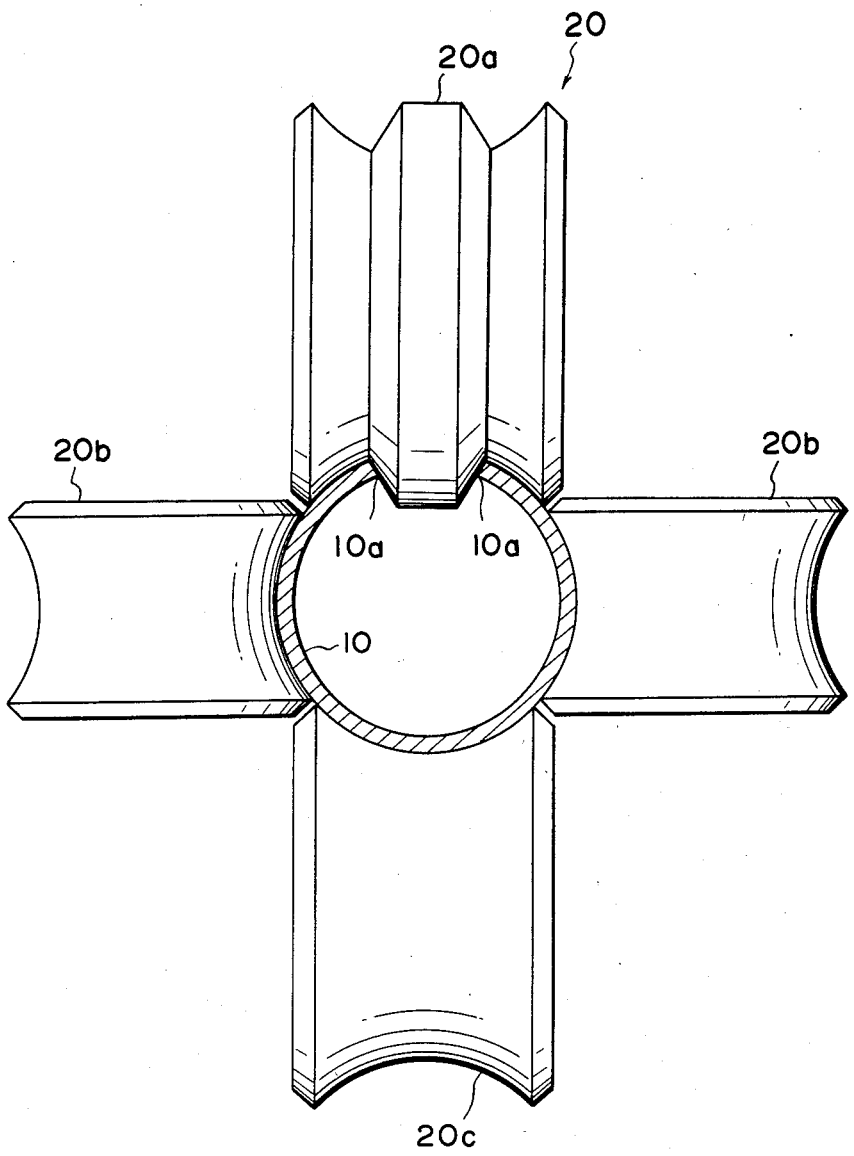
FIG. 3 (PRIOR ART)
FIG. 3 is an enlarged sectional view taken along the line III—III in FIG. 2.
Figure 7:
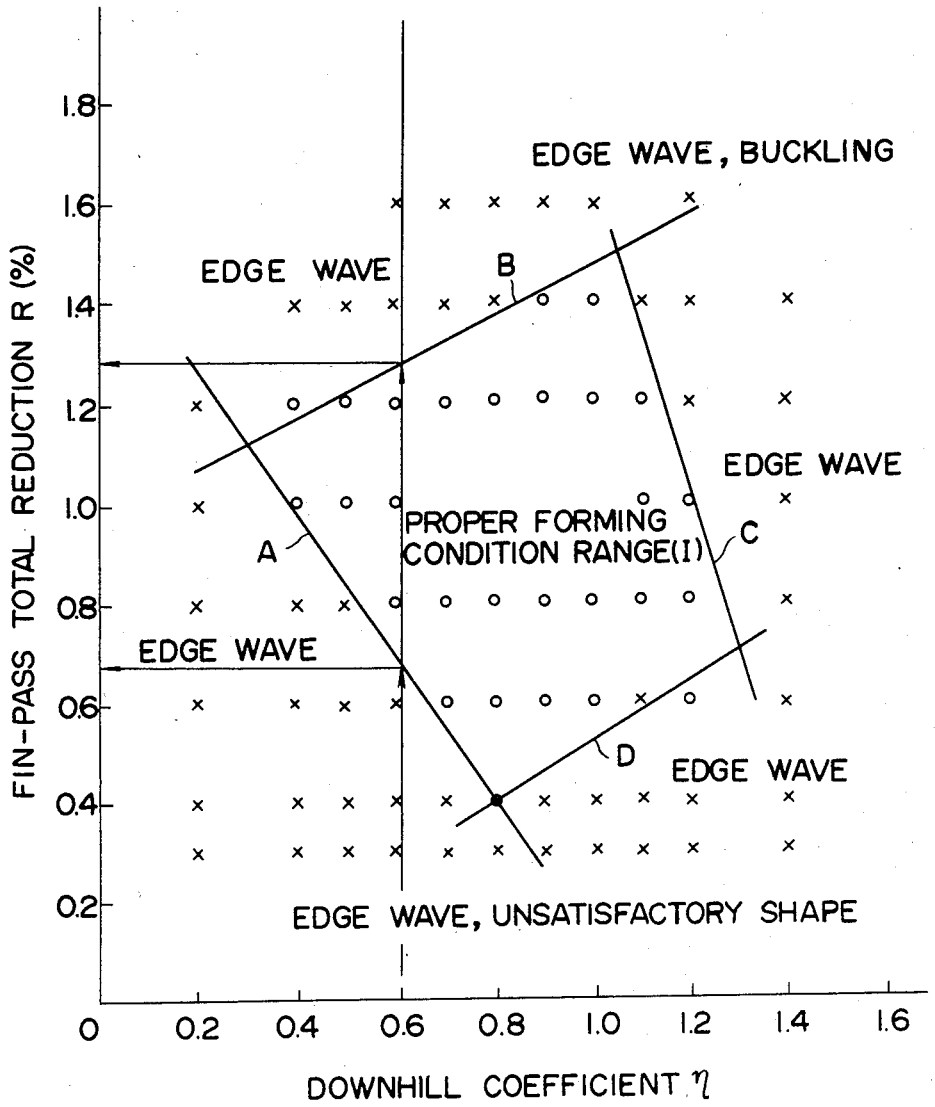
FIG. 7 is a graphic chart showing the proper forming condition range (I) of the downhill coefficient $\eta$ and the fin-pass total reduction R, capable of eliminating occurrence of edge waves in the method of forming an electric welded steel tube according to the present invention.
Figure 8:
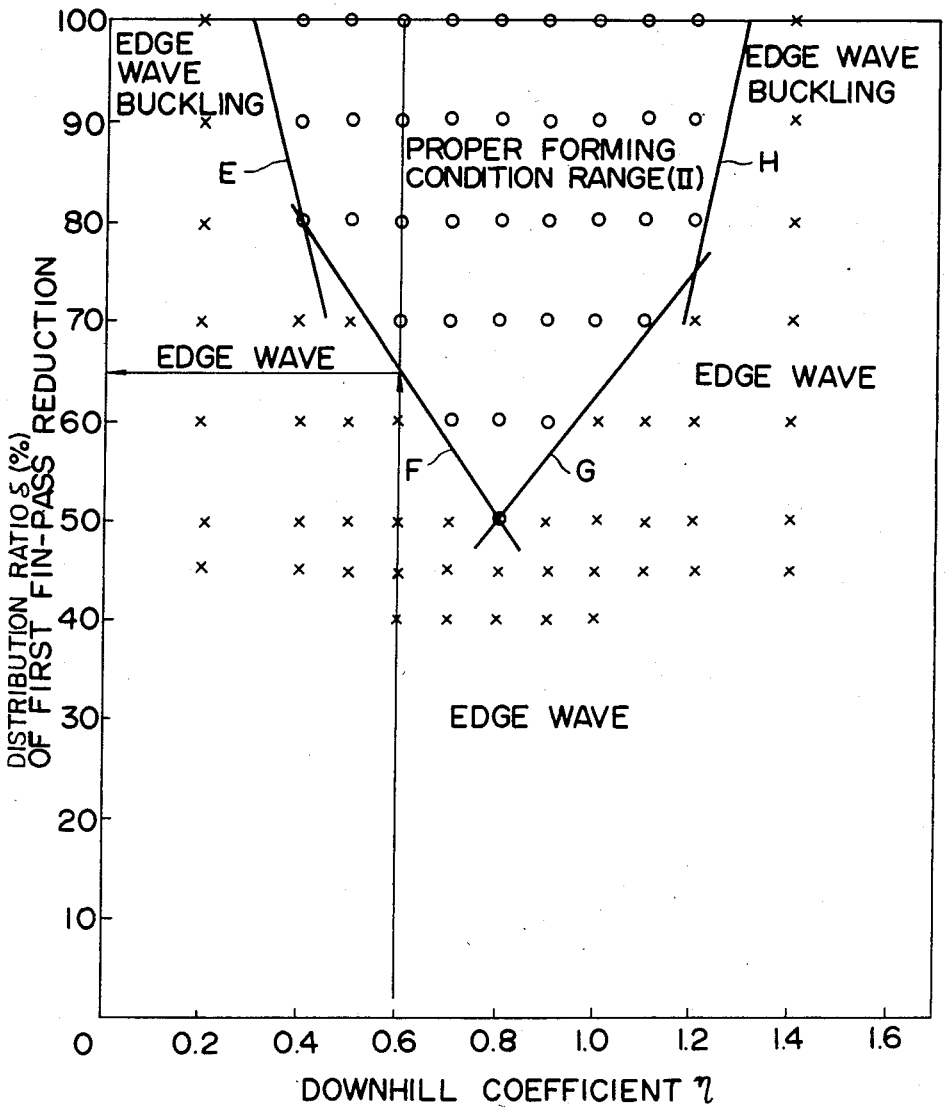
FIG. 8 is a graphic chart showing the proper forming condition range (II) of the downhill coefficient $\eta$ and the distribution ratio $\delta$ of the first fin-pass reduction.
Figure 13:
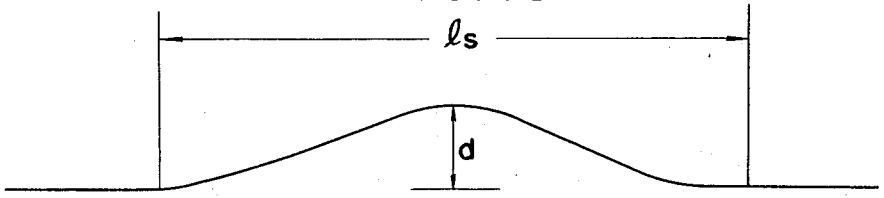
FIG. 13 is a schematic view showing the method of evaluating an edge wave.

FIGS. 7 and 8 show the results of the experiments of the first embodiment and an example being compared. The experimental materials are high strength electric welded steel tubes meeting the requirements of API5LX.X-60 of API standards and having a ratio of t/D of about 1.0% (where t is the thickness and D the outer diameter of the tube). Referring to the drawings, circular marks (o) show the cases where occurrence of edge waves was eliminated and cross marks (x) show the cases where edge waves occurred. Here, the judgement as to the presence or absence of an edge wave was performed by measuring the steepness (d/ls) of an edge wave, which is obtained by dividing the depth d of an edge wave by a span ls of the edge wave, as shown in FIG. 13. More specifically, As the results of detailed studies on the influence of the steepness of an edge wave onto the quality of the welded portion, it was found that, when the steepness (d/ls) of an edge wave less than $20\times10^{-4}$ did not matter. Consequently, the judgement as to the presence or absence of an edge wave is performed such that, when d/ls $\leqq 20\times10^{-4}$, there is no occurrence of an edge wave or waves, and, when d/ls $>20\times10^{-4}$, there is occurrence of an edge wave or waves. In addition, the distribution ratios $\delta$ of the first fin-pass reduction at the circular marks (o) which are free from occurrence of edge waves as shown in FIG. 7 are supposed not to depart from the range of the proper distribution ratio of the first fin-pass reduction shown in FIG. 8.

Description will now be given of the method of selecting the proper forming conditions capable of eliminating occurrence of cambers in conjunction with a second embodiment of the present invention. In the case of adopting the downhill forming by the downhill coefficient $\eta=0.6$ for example, the fin-pass total reduction R and the distribution ratio $\delta$ of the first fin-pass reduction are selected in consideration of improvements in the yield rate of the material and prevention of occurrence of flaws in rolls such that the fin-pass total reduction R is set at a value within a range of about 0.8% to 1.3% as apparent from FIG. 9 and the distribution ratio $\delta$ of the first fin-pass reduction is set at a value within a range of 75% to 100% as apparent from FIG. 10. With the above-described arrangement, an excellent tube free from cambers can be formed. Additionally, as for the selection of the downhill value, it must be very useful in improving the productivity in the actual operation as viewed from the problem of the periods of time required for changes in the downhill value setting to select the downhill value $D_H$ so that the proper forming condition range of the fin-pass total reduction R and the distribution ratio $\delta$ of the first fin-pass reduction according to the present invention can be relatively wide.

Figure 9:
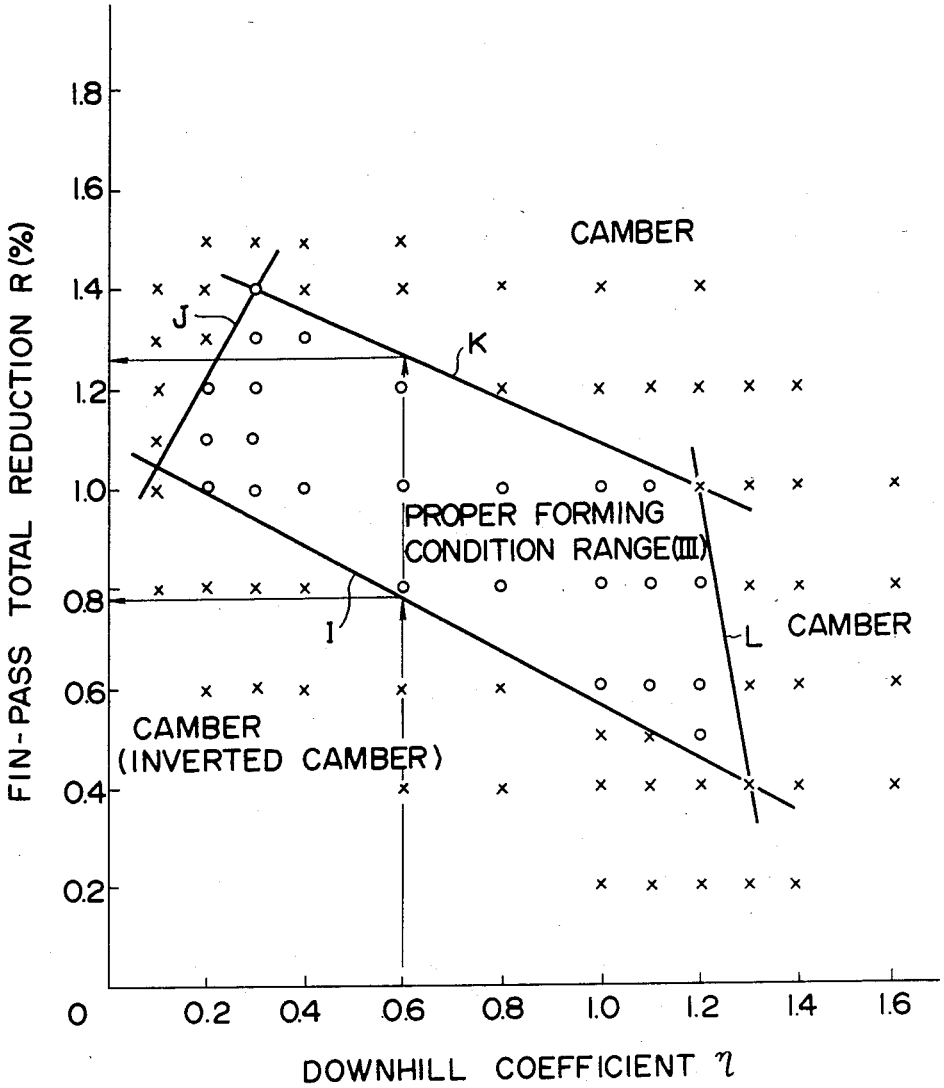
FIG. 9 is a graphic chart showing the proper forming condition range (III) of the downhill coefficient $\eta$ and the fin-pass total reduction R, capable of eliminating occurrence of cambers in the method of forming an electric welded steel tube according to the present invention.
Figure 10:
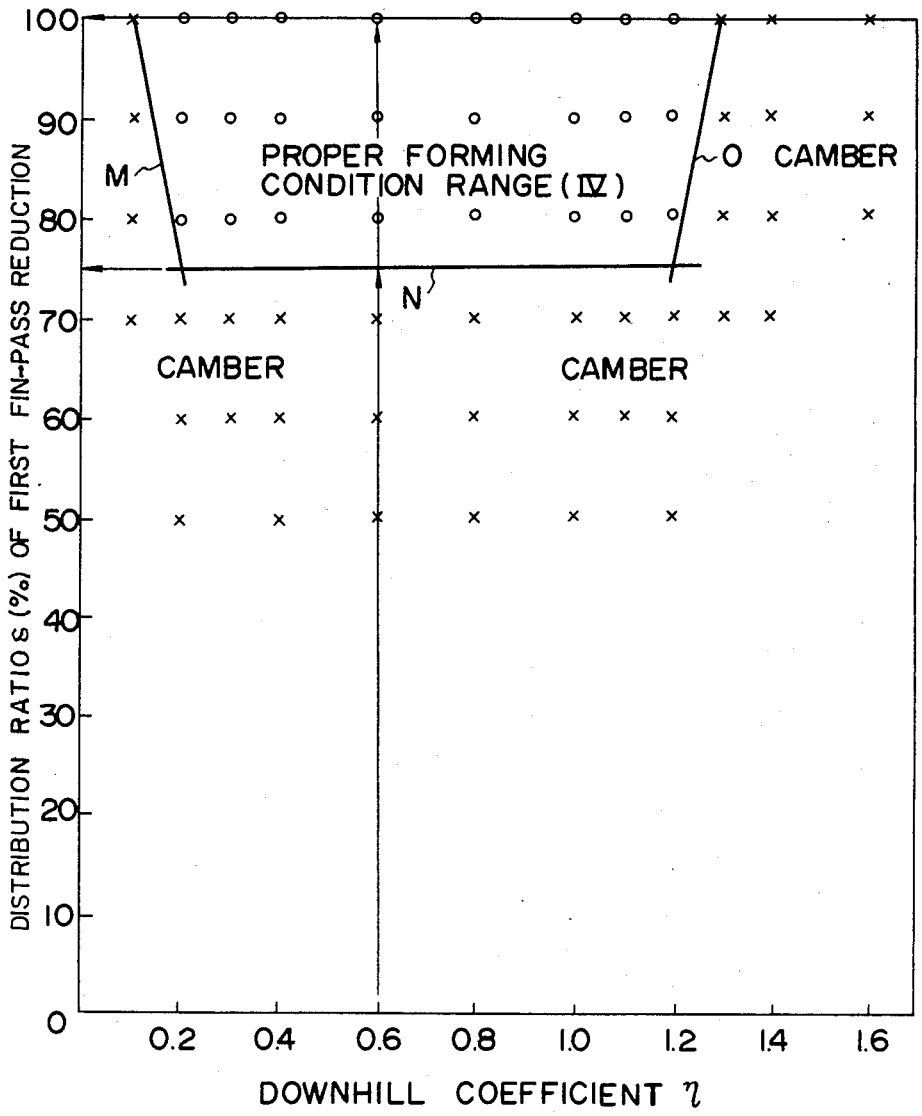
FIG. 10 is a graphic chart showing the proper forming condition range (IV) of the downhill coefficient $\eta$ and the distribution ratio $\delta$ of the first fin-pass reduction.
Figure 14:
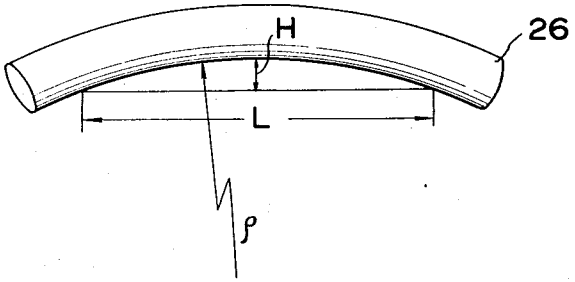
FIG. 14 is a perspective view showing the method of measuring a camber of a tube.

FIGS. 9 and 10 show the results of the experiments of the second embodiment and an example being compared. The experimental materials are high strength electric welded steel tubes meeting the requirements of API5LX.X-60 of API standards and having a ratio of t/D of about 1.0% (where t is the thickness and D the outer diameter of the tube). Referring to the drawings, circular marks (o) show the cases where occurrence of cambers was eliminated and cross marks (x) show the cases where cambers occurred. In addition, referring to FIG. 9, under the forming conditions where both the downhill coefficient $\eta$ and the fin-pass total reduction R are small, an inverted camber having a shape shown in FIG. 6(B) occurs, however, under other improper forming conditions, a camber having a shape shown in FIG. 6(A) occurs. Here, the evaluation of the cambers in the longitudinal direction of the tube is performed such that a value of camber H is measured by a measuring span L as shown in FIG. 14 and the radius of curvature $\rho$ of a camber of the tube is calculated, and the curvature $(1/\rho)$ of the camber is made as an index of the evaluation of camber. More specifically, when the curvature of camber $1/\rho$ is less than $6.6\times10^{-7}$ $(mm^{-1})$ based on the product specification standards, an evaluation of non-occurrence of camber is rendered. Additionally, the distribution ratio $\delta$ of the first fin-pass reduction at the circular marks (o) which are free from occurrence of cambers as shown in FIG. 9 are supposed not to depart from the range of the proper distribution ratio of the first fin-pass reduction shown in FIG. 10.

Description will hereunder be given of the method of selecting the proper forming conditions capable of eliminating occurrence of edge waves and cambers in conjunction with a third embodiment of the present invention. In the case of adopting the downhill forming by the downhill coefficient $\eta=0.6$ for example, the fin-pass total reduction R and the distribution ratio $\delta$ of the first fin-pass reduction are selected in consideration of improvements in the yield rate of the material and prevention of occurrence of flaws in rolls such that the fin-pass total reduction R is set at a value within a range of about 0.8% to 1.25% as apparent from FIG. 11 and the distribution ratio $\delta$ of the first fin-pass reduction is set at a value within a range of 75% to 100% as apparent from FIG. 12. With the above-described arrangement, an excellent tube free from edge waves and cambers can be formed. Additionally, as for the selection of the downhill value, it must be very useful in improving the productivity in the actual operation as viewed from the problem of the periods of time required for changes in the downhill value setting to select the downhill value $D_H$ so that the proper forming condition range of the fin-pass total reduction R and the distribution ratio $\delta$ of the first fin-pass reduction according to the present invention can be relatively wide.

Figure 11:
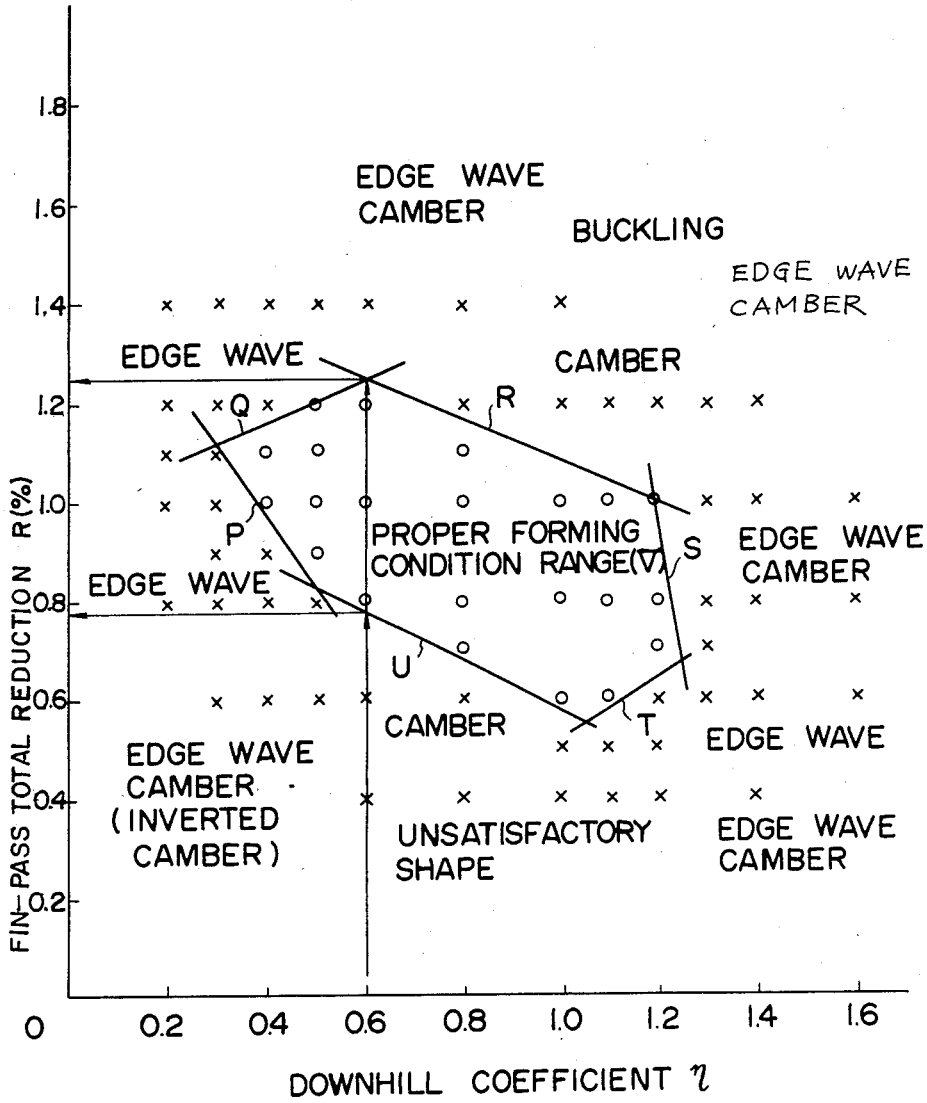
FIG. 11 is a graphic chart showing the proper forming condition range (V) of the downhill coefficient $\eta$ and the fin-pass total reduction R, capable of eliminating occurrence of edge waves and cambers in the method of forming an electric welded steel tube.
Figure 12:
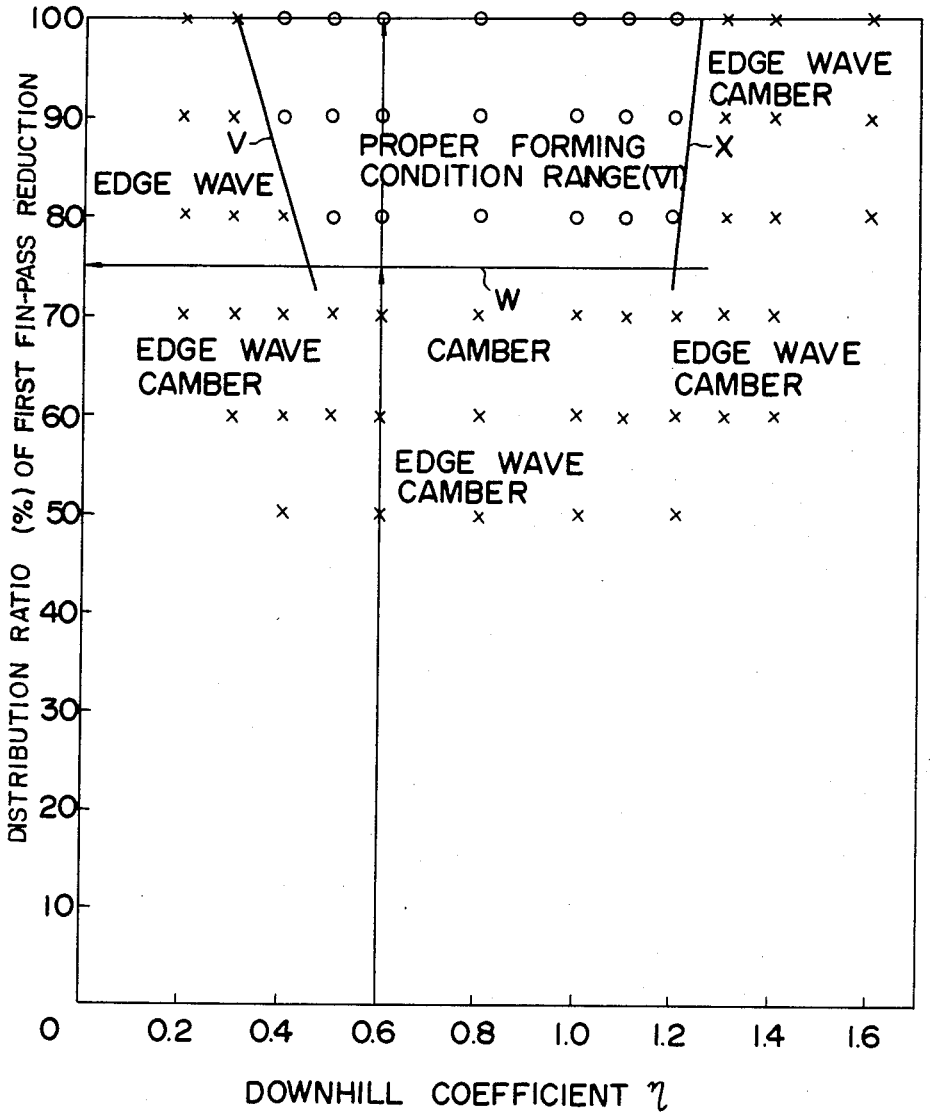
FIG. 12 is a graphic chart showing the proper forming condition range (VI) of the downhill coefficient $\eta$ and the distribution ratio $\delta$ of the first fin-pass reduction.

FIGS. 11 and 12 show the results of the experiments of the third embodiment and an example being compared. The experimental materials are high strength electric welded steel tubes meeting the requirements of API5LX.X-60 of API standards and having a ratio of t/D of about 1.0% (where t is the thickness and D the outer diameter of the tube). Referring to the drawings, circular marks (o) show the cases where occurrence of edge waves and cambers was eliminated and cross marks (x) show the cases where edge waves or cambers occurred. Here, judgement as to the presence or absence of an edge wave or a camber in the longitudinal direction of the tube was performed by a method similar to those in the aforesaid first and second embodiment. Additionally, the distribution ratio $\delta$ of the first fin-pass reduction at the circular marks (o) which are free from occurrence of edge waves and cambers as shown in FIG. 11 are supposed not to depart from the range of the proper distribution ratio of the first fin-pass reduction shown in FIG. 12.

Figure 5:
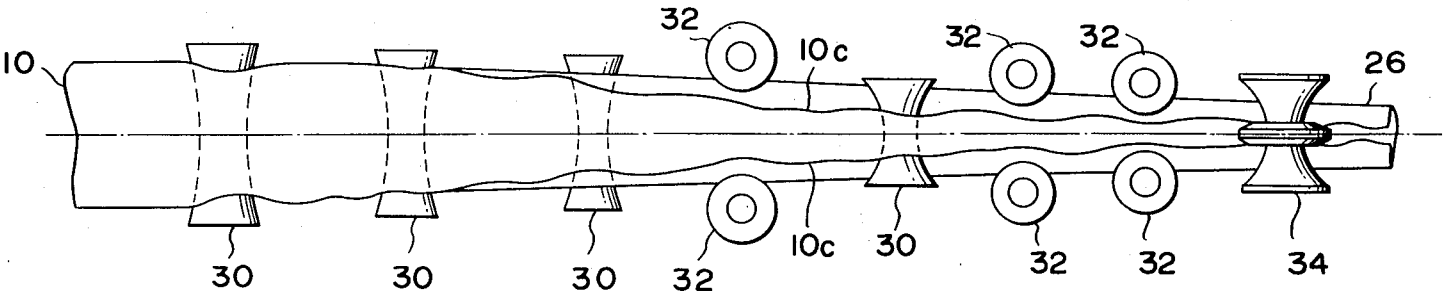
FIG. 5 (PRIOR ART)
FIG. 5 shows a plan view showing the conditions of generating edge waves in the conventional step roll type electric welded steel tube forming mill.

While the present invention has been applied to the cage roll type electric welded steel tube forming mill in each of the above-described embodiments, it is to be understood that the invention is not limited to the specific form described above and that it can be similarly applied to the cases of a step roll forming, as shown in FIG. 5, or of a semi-cage roll formal which is the combination of the step forming and the cage roll forming, in the case of practicing downhill forming.

It should be apparent to those skilled in the art that the above-described embodiments are merely illustrative, which represent the applications of the principles of the present invention. Numerous and varied other arrangements can be readily devised by those skilled in the art without departing from the spirit and the scope of the invention.

What is claimed is:

1. A method of forming an electric welded steel tube, comprising:

selecting a desired tube diameter;

calculating, using the desired tube diameter, a distance $D_H$ such that a ratio $\eta$ between the distance $D_H$ and the desired tube diameter is within a range of values between 0.3 and 1.3;

feeding a heated sheet into a cage roller assembly;

downhill forming the heated sheet such that the calculated distance $D_H$ is created between a level of feeding the sheet into the cage roller assembly and a lowered central portion of said heated sheet, thereby forming a cylindrical shape;

fin-pass forming the cylindrically shaped sheet and reducing a diameter of said cylindrical sheet by using tandem type fin-pass rollers, such that the total reduction R of said fin-pass forming is within a range of values between 0.4% and 1.5% and satisfying the following relationships:

$$R \geqq -1.44\eta + 1.552$$

$$R \leqq 0.51\eta + 0.966$$

$$R \leqq -3.20\eta + 4.86$$

$$R \geqq 0.60\eta + 0.08$$

wherein the fin-pass total reduction R is the sum of the reductions $r_i$ of all of the fin-pass rollers of the cage roller assembly, the reduction $r_i$ for each stand being $$100 \ln(l_i - 1/l_i)$$

where $l_i$ is the outer circumferential length of the tube at the outlet of the ith fin-pass roller;

selecting a distribution ratio $\delta$ of a first circumferential reduction of said fin-pass forming at a value of more than 50% of said total reduction R and satisfying the following relationships:

$$\delta \geqq -200\eta + 160$$

$$\delta \geqq -75\eta - 110$$

$$\delta \geqq 62.5\eta$$

$$\delta \geqq 250\eta - 225$$

wherein the distribution ratio $\delta$ of the first circumferential reduction is $$100\, r_1/R$$

with $r_1$ being the reduction of the first fin-pass roller of the cage assembly;

heating longitudinal edges of said heat cylindrically shaped sheet;

welding the longitudinal edges of said heated cylindrically shaped sheet together to form a welded tube, whereby edge waves are prevented in the welded tube.

2. The method of claim 1, wherein the longitudinal edges of said heated cylindrically shaped sheet are heated after the fin-pass forming.

3. The method of claim 2, wherein the heating of the longitudinal edges occurs by induction.

4. The method of claim 3, wherein the longitudinal edges of the cylindrically shaped sheet are welded by upset butt welding.

5. A method of forming an electric welded steel tube, comprising:

selecting a desired tube diameter;

calculating, using the desired tube diameter, a distance $D_H$ such that a ratio $\eta$ between the distance $D_H$ and the desired tube diameter is within a range of values between 0.3 and 1.3;

feeding a heated sheet into a cage roller assembly;

downhill forming the heated sheet such that the calculated distance $D_H$ is created between a level of feeding the sheet into the cage roller assembly and a lowered central portion of said heated sheet, thereby forming a cylindrical shape;

fin-pass forming the cylindrically shaped sheet and reducing a diameter of said cylindrical sheet by using tandem type fin-pass rollers, such that the total reduction R of said fin-pass forming is within a range of values between 0.4% and 1.5% and satisfying the following relationships:

$$R \geqq -0.542\eta + 1.104$$

$$R \leqq 1.750\eta + 0.875$$

$$R \leqq -0.444\eta + 1.533$$

$$R \leqq -6.00\eta + 8.20$$

wherein the fin-pass total reduction R is the sum of the reduction $r_i$ of all of the fin-pass rollers of the cage roller assembly, the reduction $r_i$ for each stand being $$100 \ln(l_i - 1/l_i)$$

where $l_i$ is the outer circumferential length of the tube at the outlet of the ith fin-pass roller;

selecting a distribution ratio $\delta$ of a first circumferential reduction of said fin-pass forming at a value of more than 50% of said total reduction R and satisfying the following relationships:

$$\delta \geqq -250\eta + 125$$

$$\delta \geqq -75\eta$$

$$\delta \geqq 250\eta - 225$$

wherein the distribution ratio $\delta$ of the first circumferential reduction is $$100\, r_1/R$$

with $r_1$ being the reduction of the first fin-pass roller of the cage assembly;

heating longitudinal edges of said heated cylindrically shaped sheet;

welding the longitudinal edges of said heated cylindrically shaped together to form a welded tube, whereby a camber in the longitudinal direction of the tube is prevented.

6. The method of claim 5, wherein the longitudinal edges of said heated cylindrically shaped sheet are heated after the fin-pass forming.

7. The method of claim 3, wherein the heating of the longitudinal edges occur by induction.

8. The method of claim 4, wherein the longitudinal edges of the cylindrically shaped sheet are welded by upset butt welding.

9. A method of forming an electric welded steel tube, comprising:

selecting a desired tube diameter;

calculating, using the desired tube diameter, a distance $D_H$ such that a ratio between the distance $D_H$ and the desired tube diameter is within a range of values between 0.3 and 1.25;

feeding a heated sheet into a cage roller assembly;

downhill forming the heated sheet such that the calculated distance $D_H$ is created between a level of feeding the sheet into the cage roller assembly and a lowered central portion of said heated sheet, thereby forming a cylindrical shape;

fin-pass forming the cylindrically shaped sheet and reducing a diameter of said cylindrical sheet by using tandem type fin-pass rollers, such that the total reduction R of said fin-pass forming is within a range of values between 0.55% and 1.25% and satisfying the following relationships:

$$R \geqq -1.45\eta + 1.555$$

$$R \leqq 0.43\eta + 0.991$$

$$R \leqq -0.42\eta + 1.502$$

$$R \leqq -6.6\eta + 8.920$$

$$R \geqq 0.6\eta - 0.080$$

$$R \geqq -0.51\eta + 1.086$$

wherein the fin-pass total reduction R is the sum of the reduction $r_i$ of all of the fin-pass rollers of the cage roller assembly, the reduction $r_i$ for each stand being $$100 \ln(l_i - 1/l_i)$$

where $l_i$ is the outer circumferential length of the tube at the outlet of the ith fin-pass roller;

selecting a distribution ratio $\delta$ of a first circumferential reduction of said fin-pass forming at a value of more than 75% of said total reduction R and satisfying the following relationships:

$$\delta \geqq -166.67\eta + 150$$

$$\delta \geqq 75\eta$$

$$\delta \geqq 500\eta - 525$$

wherein the distribution ratio $\delta$ of the first circumferential reduction is $$100\, r_1/R$$

with $r_1$ being the reduction of the first fin-pass roller of the cage assembly;

heating longitudinal edges of said heated cylindrically shaped sheet;

welding the longitudinal edges of said heated cylindrically shaped sheet together to form a welded tube, whereby a simultaneous prevention of edge waves in the tube edge portion and a camber in the longitudinal direction of the tube is achieved.

10. The method of claim 9, wherein the longitudinal edges of said heated cylindrically shaped sheet are heated after the fin-pass forming.

11. The method of claim 10, wherein the heating of the longitudinal edges occurs by induction.

12. The method of claim 11, wherein the longitudinal edges of the cylindrically shaped sheet are welded by upset butt welding.

* * * * *